US005233920A

United States Patent [19]

Shinmoto et al.

[11] Patent Number: 5,233,920

[45] Date of Patent: Aug. 10, 1993

[54] IMAGE ADJUSTING DEVICE FOR OFFSET PRINTING MACHINE

[75] Inventors: Takahiko Shinmoto; Hideki Doumoto; Takashi Kimura, all of Fuchu, Japan

[73] Assignee: Ryobi Limited, Tokyo, Japan

[21] Appl. No.: 896,683

[22] Filed: Jun. 10, 1992

[30] Foreign Application Priority Data

Jun. 13, 1991 [JP] Japan ..... 3-142141
May 15, 1992 [JP] Japan ..... 4-123612

[51] Int. Cl.[5] ..... B41J 33/32

[52] U.S. Cl. ..... 101/248; 101/181; 74/398

[58] Field of Search ..... 101/247, 248, 181, 182, 101/183, 180, 174, 177, 178, 136, 138, 139, 140, 216, 219, 217, DIG. 36; 74/395, 398, 399, 400, 402

[56] References Cited

U.S. PATENT DOCUMENTS

| | | | |
|---|---|---|---|
| 3,641,933 | 2/1972 | Tafel | 101/181 |
| 3,717,092 | 2/1973 | Crum | 101/181 |
| 3,742,849 | 7/1973 | Greiner et al. | 101/248 |
| 4,006,685 | 2/1977 | Mosemiller | 101/247 |
| 4,350,093 | 9/1982 | Ishii | 101/217 |
| 4,572,074 | 2/1986 | Guaraldi | 101/181 |
| 4,573,408 | 3/1986 | Bezler et al. | 101/248 |
| 4,581,993 | 4/1986 | Schoneberger | 101/248 |
| 4,787,261 | 11/1988 | Becker | 101/248 |
| 4,833,983 | 5/1989 | Chen | 101/181 |
| 4,879,950 | 11/1989 | Ishii | 101/217 |

*Primary Examiner*—Eugene H. Eickholt
*Attorney, Agent, or Firm*—Brooks & Kushman

[57] ABSTRACT

An image adjusting device for an offset printing machine includes a drive source, an adjustment gear mounted on a rotary shaft and always engaged with a gear mounted on a blanket cylinder for adjusting a position of an image to be printed, a clutch mechanism for selectively transmitting a rotation of the drive source to the adjustment gear, and an encoder for controlling a rotational amount of the adjustment gear, the encoder being mounted on the rotary shaft. Further the image adjusting device has first and second detectors for detecting the rotational positions of the blanket cylinder and a cylinder gear, respectively, a microcomputer provided with calculating means for calculating standard and present phase differences between the blanket cylinder and the cylinder gear, and an input means for inputting an amount of adjustment on the basis of the present phase difference therebetween. Thus, it is possible to more correctly effect the image adjustment in the offset printing press.

14 Claims, 10 Drawing Sheets

IMAGE ADJUSTING DEVICE FOR OFFSET PRINTING MACHINE

BACKGROUND OF THE INVENTION

The present invention relates to an offset printing machine and more particular to an offset printing machine in which an exact adjustment of image position may be effected for keeping a printing image position constant relative to a piece of fed paper.

With a variety of printing plates, including a paper printing for an offset printing plate machine or press, it is very difficult to position a pictorial image portion exactly at a predetermined position of the printing plate during a printing operation. It is inevitable that a small amount of displacement or shear in image position will be left between an original and the printing plate for every printing.

It is therefore necessary to keep constant a printing image position relative to the fed paper by adjusting the image position against the displacement of the printing portion or the displacement caused upon loading the printing plate onto a printing cylinder whenever the printing plate is replaced by another on the printing cylinder during the printing operation.

An example of such an offset printing machine is disclosed in Japanese Examined Patent Publication No. Hei 2-16215. The machine will be explained with reference to FIGS. 9 and 10 in which an adjustment gear 116 is mounted on a frame 113 supporting a first rubber blanket cylinder 101. The adjustment gear 116 is axially movable by a solenoid 114 and is drivingly rotatable by a gear 124 mounted on a shaft of a step motor 115. The rotation of the adjustment gear 116 is transmitted, through a gear 131 and a gear transmission mechanism 118 supported, through a bracket 117, by a cylinder gear 107, to a worm wheel 129 provided on the bracket 117.

The above described gear transmission mechanism 118 is constructed as follows. A spur gear 125 and a bevel gear 126 are disposed on a shaft 127 rotatably supported on the bracket 117 fixed to the cylinder gear 107. The worm gear 129 and a bevel gear 128 which is arranged perpendicular to the shaft 127 are disposed on a common shaft 130 rotatably supported on the bracket 117 but are not displaceable in the axial direction. Both the bevel gears 126 and 128 are engaged with each other. The spur gear 125 is engaged with the gear 131 which is engagable with the adjustment gear 116. The worm gear 129 is engaged with sector gear 119 fixed to one side of the rubber blanket cylinder 101. The sector gear 119 is rotated together with the rubber blanket cylinder 101.

The cylinder gear 107 is engaged with another cylinder gear 108 of a rubber blanket compression cylinder 103, so that both the rubber blanket and compression cylinders 101 and 103 are rotated in synchronism with each other.

As described above, an adjustment shaft **116*a* of the adjustment gear 116 passes through a hole 120*a* of a support member 120 fixed to the frame 113 so that the adjustment shaft 116*a* is rotatably slidable in the axial direction. The adjustment gear 116 is fixed to an inward end of the adjustment shaft 116*a* whereas the other end of the adjustment shaft 116*a* is coupled to an operating rod 122 supported on a bracket 121 fixed to the frame 113 and drivingly swung by the solenoid 114. A spring 123 is laid around the adjustment shaft 116*a* so that the adjustment gear 116 is out of engagement with the gear 131 of the above described gear transmission mechanism 118 during the non-operation period of the solenoid 114**.

Upon the image position adjustment, the solenoid 114 is operative and the adjustment shaft **116*a* is pushed inwardly against the biasing force of the spring 123. As a result, the adjustment gear 116 is engaged with the gear 131 of the gear transmission mechanism 118. Under this condition, when the step motor 115 is driven, the rotation of the adjustment gear 116 is transmitted through the gear transmission mechanism 118 to the worm wheel 129 to thereby rotate the blanket gear 107 relative to the rubber blanket cylinder 101** for the adjustment of the image position.

However, in the conventional image adjusting device for the offset printing machine, in the case where the adjustment gear 116 is moved in the axial direction by the solenoid 114 and engaged with the gear 131 to adjust the image, there is a fear that the gear 116 would not be well engaged with the gear 131 due to, for example, an abutment between teeth of these gears even if crests of these teeth would be rounded or bevelled. In such a case, the motor 115 rotates, the gear 116 is rotated through the shaft **116*a* by the rotation of the motor 115, the crests of the gears 116 and 131 are moved out of abutment with each other, and then the crests and the troughs of these gears are engaged with each other. Through these operations, the rotation of the gear 116 is finally transmitted to the gear 131**.

In this case, it should be noted that the motor 115 rotates by an amount sometimes greater than the amount corresponding to the actual image movement. Since a portion of the movement by the motor 115 is consumed before the gears 116 and 131 mesh with each other as described above, all of its rotation is not transmitted to the gear 131.

Further, a gear transmission mechanism 124 consisting of the gear 140 and a gear 150 engaged with the gear 140 for transmission of the rotation of the motor 115 to the shaft **116*a* suffers from a backlash. Thus, the exact rotational amount of the motor 115 is not always transmitted to the gear 116**.

Therefore, the conventional image adjusting device suffers, mainly for the two reasons, from such a defect that the rotational amount of the motor which rotates in response to the number of pulses corresponding to the image position movement calculated and set in advance is not exactly transmitted to the gear 131 and the image position movement is not accurate.

SUMMARY OF THE INVENTION

In order to solve the above noted difficulty inherent to the conventional technology, an object of the present invention is to provide an image adjusting device for an offset printing machine, which device may transmit correctly an image displacement by a gear transmission mechanism.

In order to attain the object according to one aspect of the present invention, there is provided an image adjusting device for an offset printing machine, comprising: a drive source for driving gear transmission mechanism by which a phase difference between a cylinder such as a plate cylinder or a blanket cylinder and a cylinder gear for rotating the cylinder is changed; an adjustment gear always engaged with a gear mounted on said cylinder for adjusting a position of an image to be printed; a clutch mechanism for selectively transmitting a rotation of the drive source to said adjustment gear for adjusting the phase difference between the cylinder and the cylinder gear; and a rotational amount control means for controlling a rotational amount of said adjustment gear, said rotational amount control means being mounted at a first end of a rotary shaft on which said adjustment gear is mounted at a second end.

The clutch mechanism may include a pair of first and second spur gears which are arranged coaxially with each other adjacent to each other and a third spur gear which is always engaged with the first spur gear, which third spur gear is movable in an axial direction of the pair of spur gears for transmitting a rotation of the first spur gear to the second spur gear.

The device of the invention includes an axially moving means for drivingly moving the third gear in the axial direction, the axially moving means including a solenoid for selectively moving the third spur gear in a first direction, a spring biasing means for moving the third spur gear in a second direction, a link mechanism interposed between the solenoid and the spring biasing means.

The rotational amount control means may include a rotary encoder for detecting an exact rotational amount of the adjustment gear in accordance with the predetermined adjustment of movement of the printing plate. The drive source includes a stepping motor.

According to the image adjusting device of the invention, it is possible to selectively transmit the predetermined rotation of the drive source to the adjustment gear through the gear transmission mechanism. The rotational amount control unit including the rotary encoder is mounted at the first end of the rotary shaft of the adjustment gear and the rotary encoder supervises or controls the rotational amount of the adjustment gear rotated through the rotational amount transmission gear by the rotation of the drive source.

Even if a difference in rotational amount between gear components of the rotational amount transmission mechanism would be generated, since the necessary rotational amount is supervised or controlled by the rotary encoder, the correction for the difference in rotational amount may be effected without fail. Thus, according to the present invention, it is possible to rotate the adjustment gear exactly in accordance with the adjustment of movement of the cylinder because the adjustment gear is always engaged with the gear formed on the cylinder.

In order to attain the object according to another aspect of the present invention, there is provided an image adjusting device for an offset printing machine, comprising: a drive source for driving a gear transmission mechanism by which a phase difference between a cylinder such as a plate cylinder or a blanket cylinder and a cylinder gear for rotating the cylinder is changed; a first detecting means for detecting a rotational position of the cylinder; a second detecting means for detecting a rotational position of the cylinder gear; a calculating means for calculating a standard phase difference between the cylinder and the cylinder gear when the cylinder and the cylinder gear are located at their respective standard positions and a present phase difference therebetween; a memory means for memorizing the standard and present phase differences therebetween; an input means for inputting an amount of adjustment on the basis of the present phase difference therebetween; and a control means for controlling the gear transmission mechanism to change the present phase difference therebetween in response to the amount of adjustment inputted through the input means.

The image adjusting device may include a display for displaying the present phase difference on the basis of the standard phase difference.

The image adjusting mechanism may include an adjustment gear always engaged with a gear mounted on the cylinder for adjusting a position of an image to be printed, a rotational clutch mechanism for selectively transmitting a rotation of the drive source to said adjustment gear for adjusting the phase difference between the cylinder and the cylinder gear and a rotational amount control means for controlling a rotational amount of said adjustment gear, said rotational amount control means being mounted at a first end of a rotary shaft on which the adjustment gear is mounted at a second end.

According to another aspect of the present invention, the influence of backlash in the gear transmission mechanism can be effectively eliminated.

Further objects, features and other aspects of this invention will be understood from the following detailed description of the preferred embodiments of this invention with reference to the drawings.

DESCRIPTION OF THE PREFERRED EMBODIMENTS

The present invention will now be described with reference to the accompanying drawings.

First Embodiment

Figure 1:
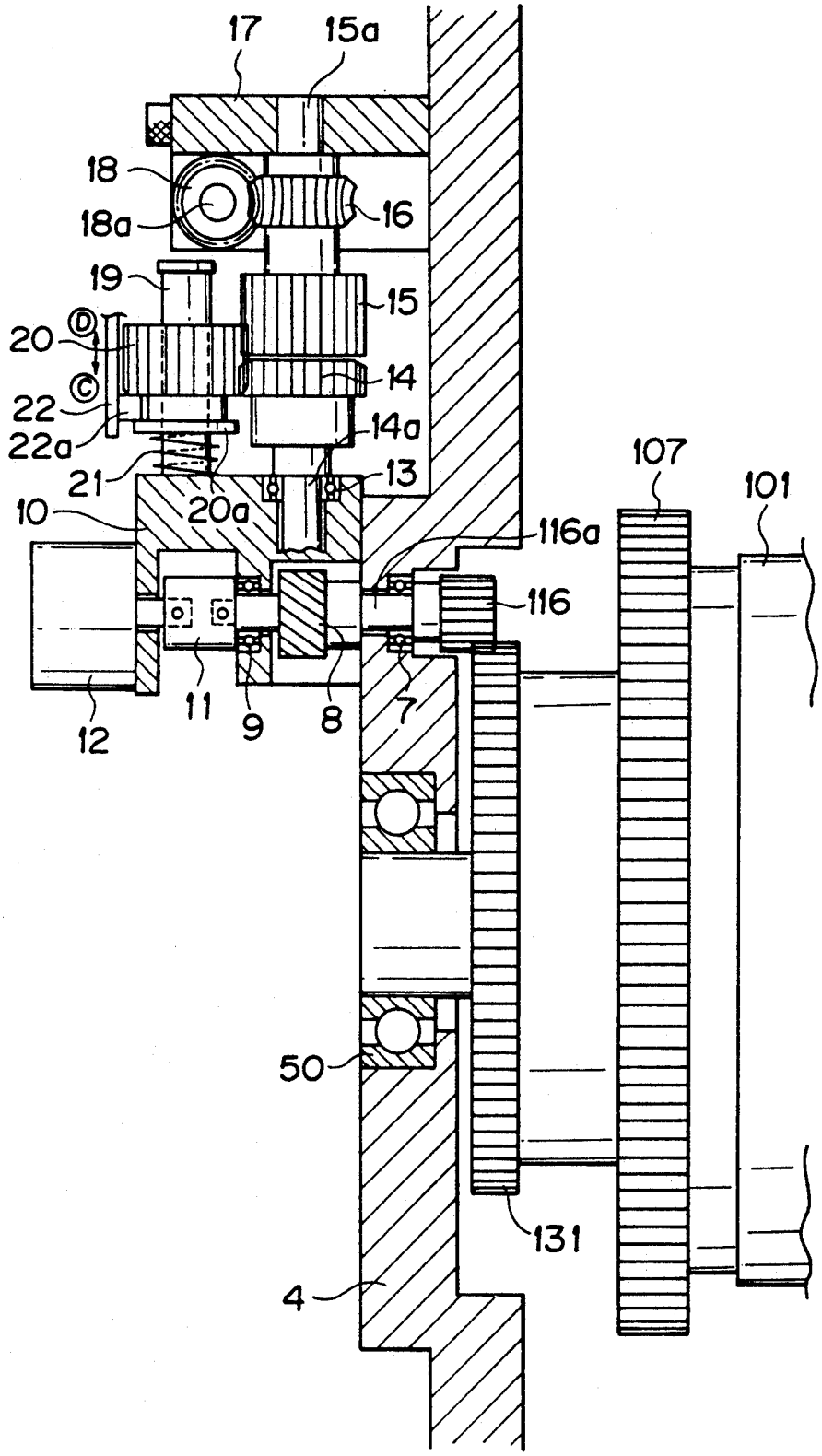
FIG. 1 is a cross sectional view showing an image adjusting device for an offset printing press in accordance with the present invention.

In FIG. 1, an adjustment gear 116 for the adjustment of a rotational amount of a rubber blanket cylinder 101 and a bevel gear 8 are mounted on a shaft **116*a* which is in turn rotatably supported by bearings 7 and 9 mounted on a frame 4. A support block 10 is mounted on the frame 4. A rotary encoder 12 which constitutes a rotational amount control unit for controlling the rotational amount of the adjustment gear 116 is mounted on the support block 10. The rotary encoder 12 and the above described shaft 116a are coupled with each other through a shaft joint 11. The adjustment gear 116 is always engaged with a spur gear 131 of the rubber blanket cylinder 101. The rotation of the spur gear 131 causes a cylinder gear 107 and the rubber blanket cylinder 101 to rotate in the same direction. The rubber blanket cylinder 101 is rotatably supported through a bearing 50 to the frame 4**.

Figure 2:
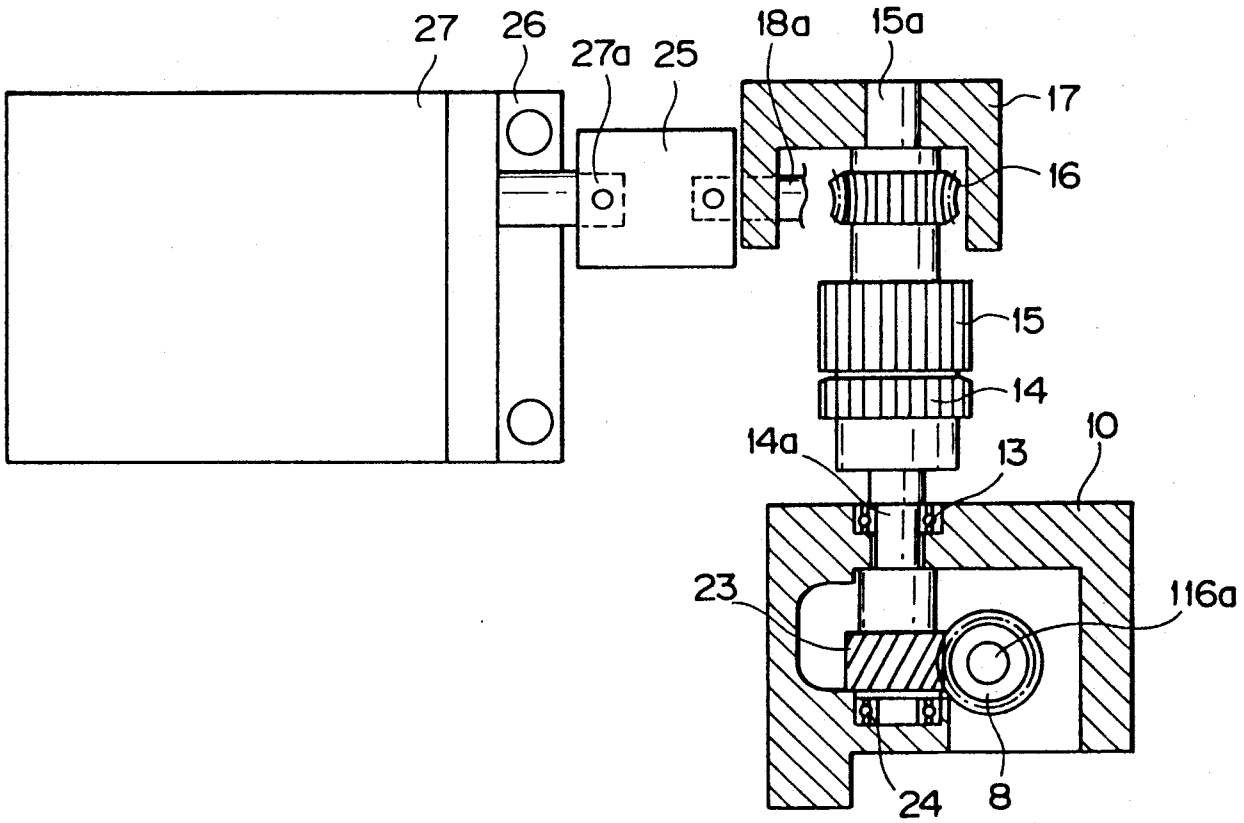
FIG. 2 is a frontal view including a cross section showing the image adjusting device shown in FIG. 1.

The bevel gear 8 mounted on the shaft 116a is engaged with another bevel gear 23 as best shown in FIG. 2. The bevel gear 23 is mounted on a shaft 14a. A spur gear 14 is mounted on the shaft 14a coaxially with the bevel gear 23. The shaft 14a is extended perpendicularly to the rotary shaft 116a and rotatably supported by upper and lower bearings 13 and 24 of the block 10. The bevel gears 8 and 23 are engaged with each other, and hence, the rotation of the shaft 116a causes the shaft 14a and the spur gear 14 to rotate. A spur gear 15 faces the spur gear 14 in coaxial relation with each other. The spur gear 15 and a worm wheel 16 are mounted on a shaft 15a which is in turn rotatably supported on a bracket 17 fixed to the frame 4. The worm wheel 16 is engaged with a worm gear 18 mounted on the bracket 17 as best shown in FIG. 3.

Figure 3:
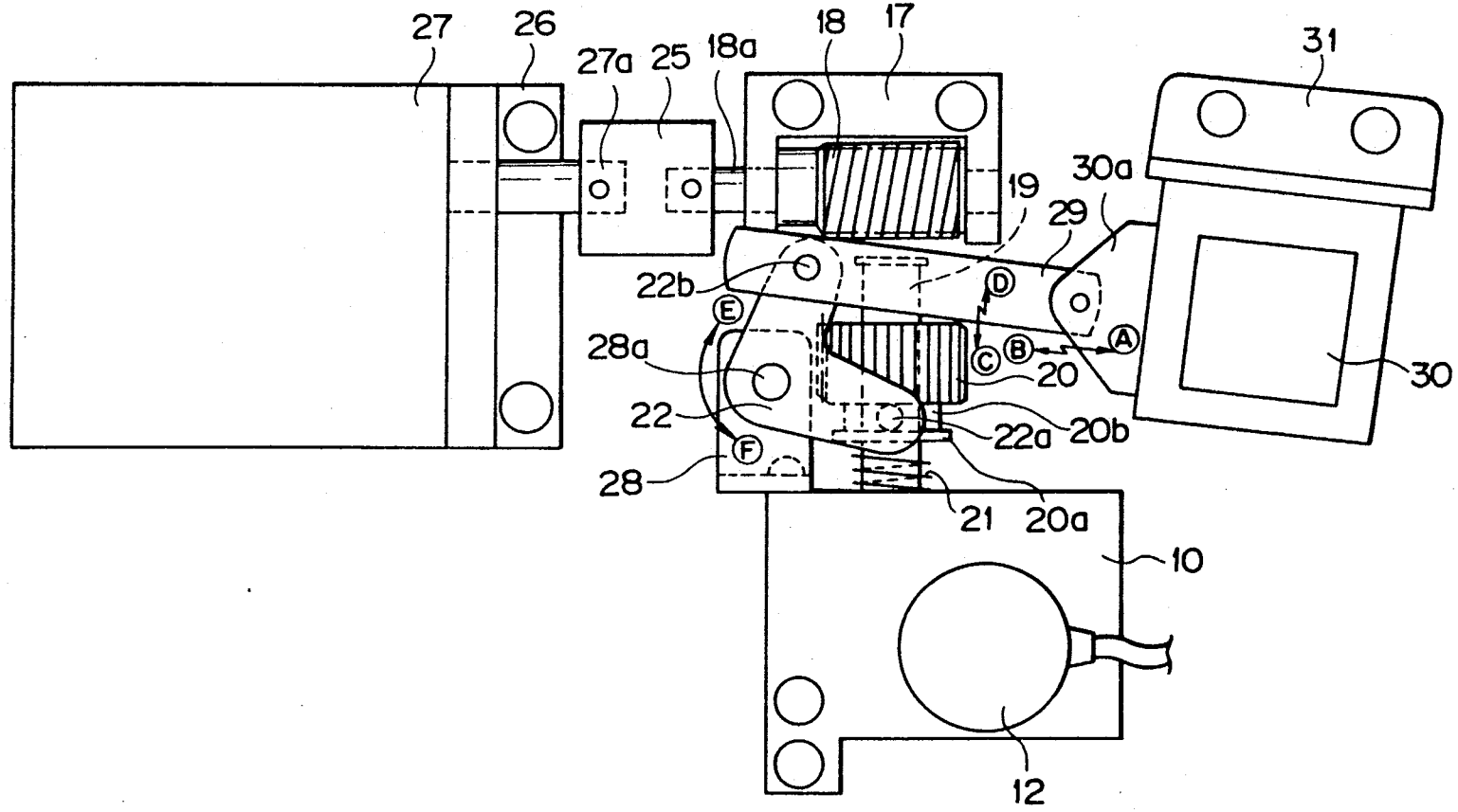
FIG. 3 is another frontal view showing a linkage for axial displacement of a spur gear shown in FIG. 1.
Figure 4:
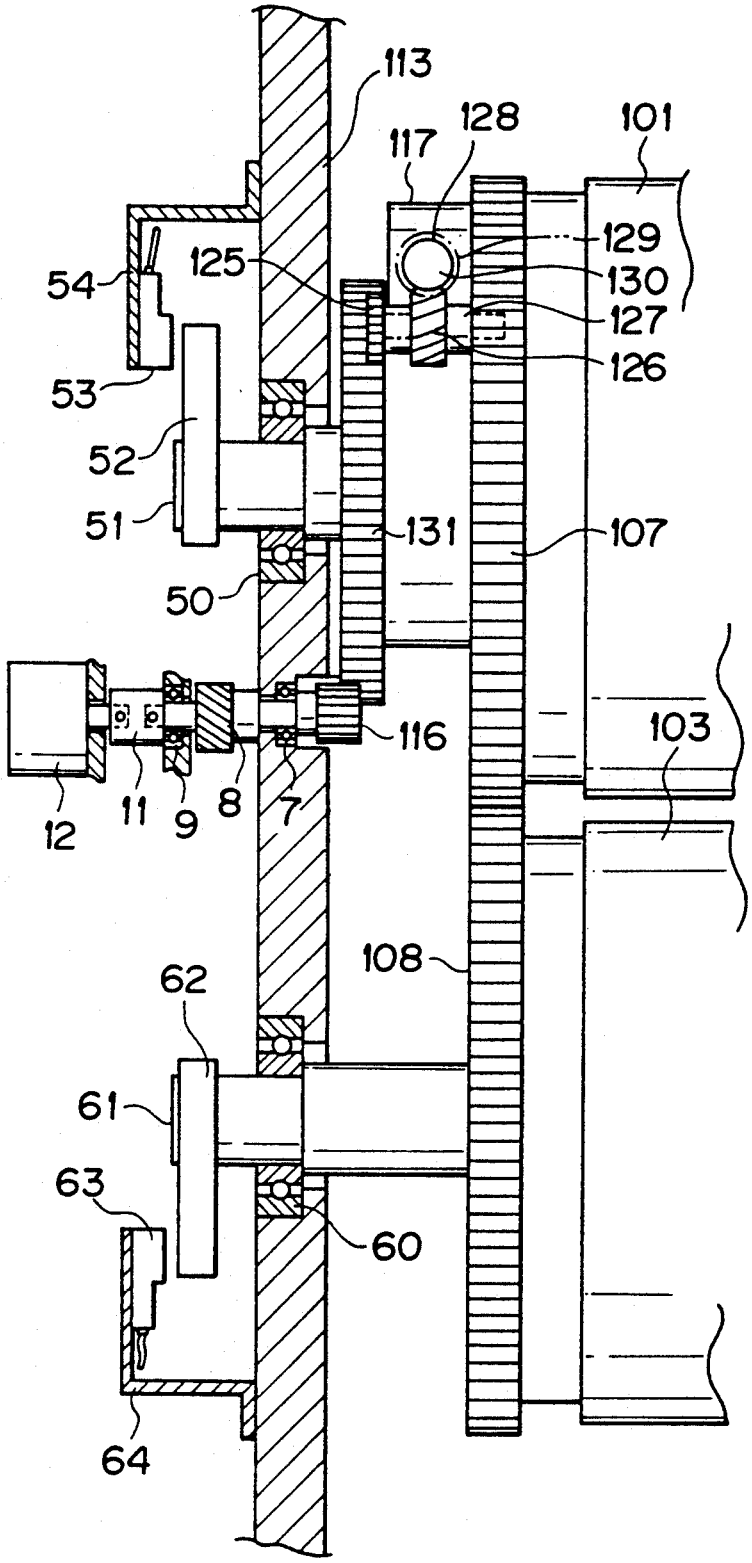
FIG. 4 is a cross sectional view showing another image adjusting device for the offset printing press in accordance with the present invention.

In FIG. 3, the worm gear 18 is mounted on a shaft 18a which is in turn rotatably supported on the bracket 17. A motor 27 such as a stepping motor is mounted on a bracket 26. The shaft 27a of the motor 27 and the shaft 18a are coupled with each other through a shaft joint 25. When the motor 27 rotates, the spur gear 15 is rotated through the worm gear 18 and the worm wheel 16.

Referring back to FIG. 1, a shaft 19 is extended parallel to the shafts 14a and 15a and mounted on the bracket or block 10. A spur gear 20 is rotatable about the shaft 19 and is movable in directions indicated by C and D (in FIGS. 1 and 3). On the other hand, a spring 21 is interposed between the block 10 and the spur gear 20 to always urge the spur gear 20 in the direction D.

A bracket 28 is mounted on the block 10. An L-shaped arm 22 is rotatably mounted about a pin 28a implanted in the bracket 28. A pin 22a is mounted at one end of the arm 22 and is engaged with a recess 20b of the spur gear 20.

A solenoid 30 is mounted on a bracket 31 which is fixed to the frame 4. The solenoid 30 is coupled through a link 29 with a pin 22b at the other end of the arm 22. When the solenoid 30 is turned on, its plunger 30a is moved in a direction A, whereas, when the solenoid is turned off, its plunger 30a is moved in a direction B.

The spur gear 20 will operate as follows. When the solenoid 30 is turned on, that is, when the plunger 30a is moved in the direction A, the arm 22 is rotated in a direction E (in FIG. 3), so that the pin 22a causes the spur gear 20 to move in the direction C. Inversely, when the solenoid 30 is turned off, the attractive force of the solenoid 30 is lost so that the spur gear 20 is moved in the direction D. In this case, the pin 22a causes the arm 22 to rotate in a direction F. The plunger 30a of the solenoid 30 is moved in the direction B. Thus, the operative and inoperative action of the solenoid 30 cause the spur gear 20 to slide in the directions C and D, respectively.

Figure 9:
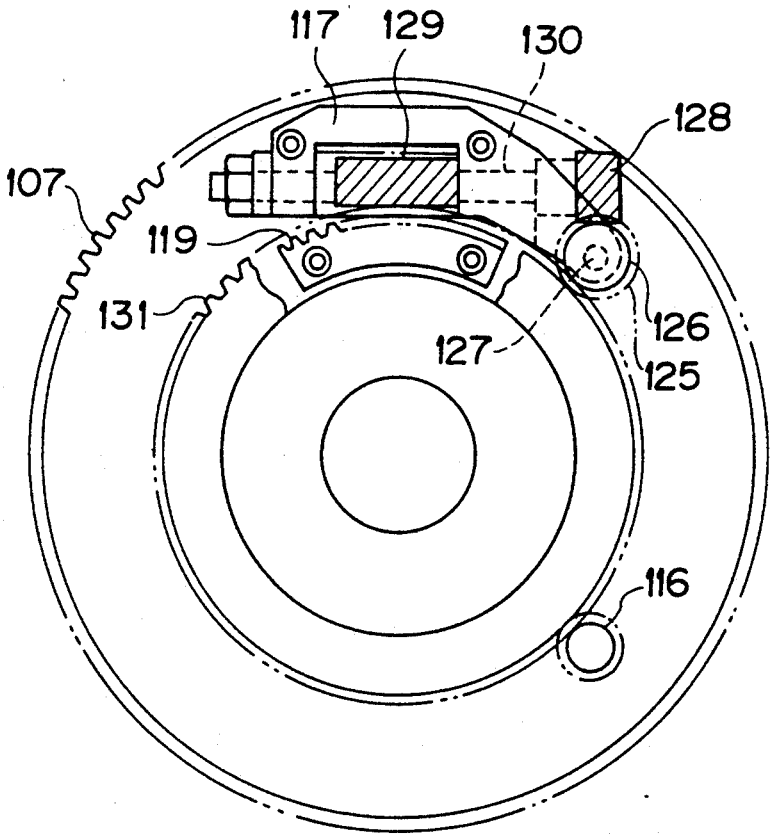
FIG. 9 PRIOR ART
FIG. 9 is a side elevational view showing a blanket cylinder of a conventional offset printing press.
Figure 10:
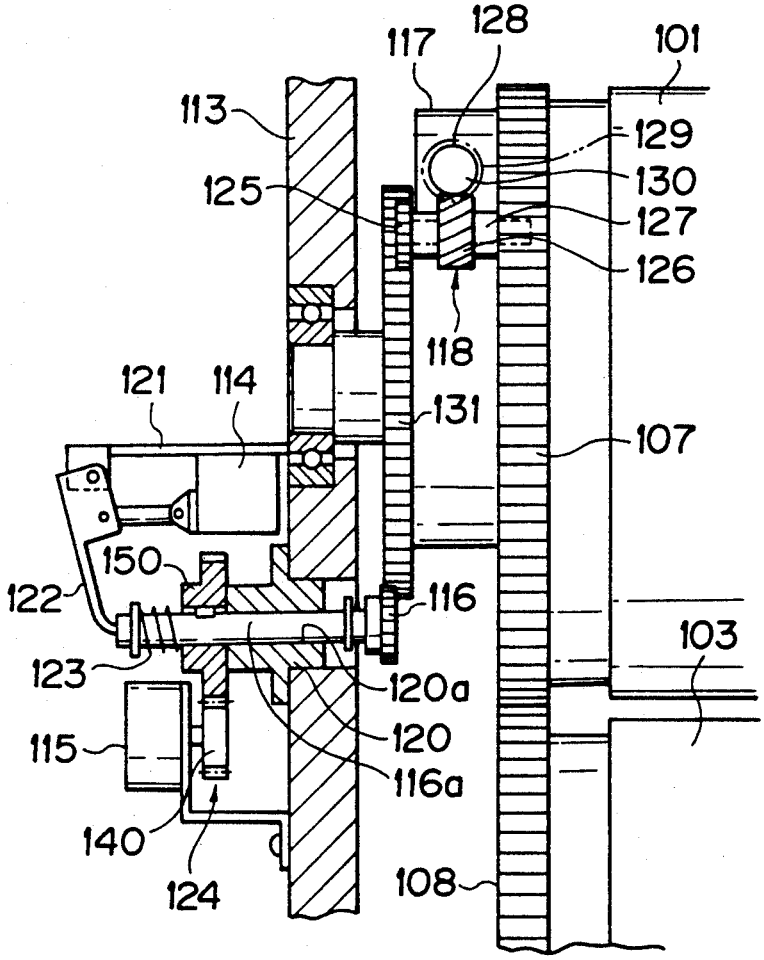
FIG. 10 PRIOR ART
FIG. 10 is a cross sectional view showing an image adjusting device of the conventional offset printing press shown in FIG. 9.

FIGS. 1 and 3 show a state where the solenoid 30 is turned on (that is, the plunger 30a is moved in the direction A). In this case, the spur gear 20 is moved in the direction C. In FIG. 2, the spur gears 14 and 15 have a common rotational centerline and these gears are not directly engaged with each other. Namely, the driving force of the spur gear 15 is not transmitted to the spur gear 14. The spur gear 20 is provided for the purpose of transmitting the driving rotation of the spur gear 15 to the spur gear 14. FIG. 1 shows a state where the spur gear 20 engages with both of the spur gears 15 and 14. In this case, the rotational force of the spur gear 15 is transmitted to the spur gear 14 through the spur gear 20. Inversely, although a state where the solenoid 30 is turned off is not shown specifically, the plunger 30a is moved in the direction B. Namely, the spur gear 20 is moved in the direction D. In this case, the spur gear 20 only engages with the spur gear 15 but does not engage with the spur gear 14. Thus, the rotation of the spur gear 15 is not transmitted to the spur gear 14 through the spur gear 20. Thus, the spur gear 20 serves as a clutch unit disposed between the spur gears 14 and 15. Accordingly, the spur gears 14, 15 and 20 constitute a clutch mechanism for transmitting a rotation of the motor 27 to the adjustment gear 116. The clutch mechanism forms a part of a first gear transmission mechanism disposed between the adjustment gear and the driving motor 27, and a second gear transmission mechanism shown in FIGS. 9 and 10 is formed between the adjustment gear 116 and the sector gear 119.

The operation for the image adjustment will be explained.

First of all, in a regular printing operation and an idle rotation, the rubber blanket cylinder 101 is rotated, and the adjustment spur gear 116 which always engages with the spur gear 131 is rotated. When the adjustment spur gear 116 is rotated, the spur gear 14 is rotated while the rotary encoder 12 and the bevel gear 8 are rotated.

Subsequently, in order to effect the image adjustment, the machine is first turned off. Thus, the rubber blanket cylinder 101 is stopped. The spur gear 14 is also stopped. The solenoid 30 is turned on in accordance with a signal fed from an image adjustment input means (as mentioned later), and the spur gear 20 is axially moved to engage with the spur gear 14. At the same time, the motor 27 starts to rotate. Even if the spur gear 20 and the spur gear 14 are disengaged with each other with the crests of the teeth of these gears abutting against each other, the rotation of the motor 27 allows the spur gear 20 to gradually rotate up to a position where these gears are engaged with each other. Thus, the engagement between these gears is insured. When the spur gears 20 and 14 are engaged with each other, the rotation of the motor 27 is transmitted to the shaft 116a through the bevel gears 23 and 8. Thus, the adjustment gear 116 causes the gear 131 on the first rubber blanket cylinder 101 to rotate to effect the image adjustment. The actual rotational amount of the spur gear 131 by the adjustment gear 116 is fed back to a control means as mentioned later through the rotary encoder 12 mounted coaxially on the shaft.

With such an arrangement, even if a difference between rotational amounts of the motor and the adjustment gear 116 occurs due to the engagement condition between gear components, the rotary encoder may determine whether or not the adjustment gear 116 is rotated exactly in accordance with a desired image adjustment amount, and may feed back the rotational amount to ensure the exact image adjustment. When the necessary image adjustment is effected, the rotation of the motor 27 is stopped, and the solenoid 30 is also turned off. Thus, the engagement between the spur gear 20 and the spur gear 14 is released. As a result, the machine is turned again back to the printing condition and machine rotation condition.

As has been described above, according to the present invention, the rotary encoder serving as a rotational amount control unit is mounted at the opposite end of the rotary shaft of the adjustment gear, and the rotational amount of the adjustment gear which has been subjected to the rotation through the first gear transmission mechanism is directly supervised or controlled. Accordingly, even if the difference such as a backlash in rotational amount between the gear components of the first gear transmission mechanism occurs, it is possible to correct the difference in rotation, and to rotate the adjustment gear exactly in accordance with the desired image adjustment to perform an accurate image adjustment.

Second Embodiment

In the first embodiment, since the encoder 12 and the adjustment gear 116 are provided on the same rotary shaft 116*a* as shown in FIG. 1, the rotational amount of the adjustment gear 116 can be detected accurately. However, the rotational amount of the adjustment gear 116 is not necessarily accurately transmitted to the sector gear 119 due to a backlash of engagement between the respective gears in the second gear transmission mechanism disposed between the adjustment gear and the sector gear 119.

FIGS. 4 to 8 show an image adjusting device which can eliminate the influence of the backlash of the gears between the adjustment gear 116 and the sector gear 119.

Figure 5:
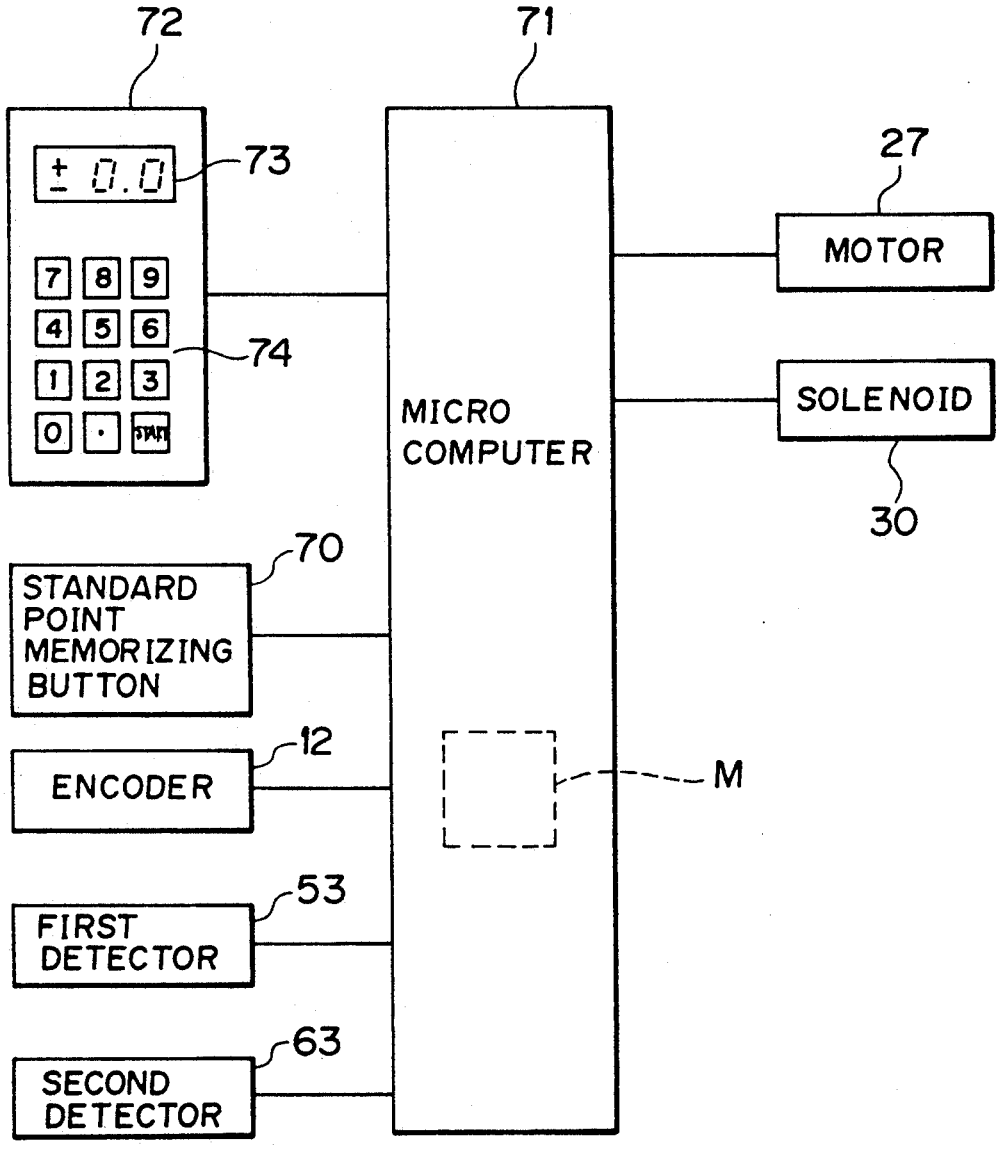
FIG. 5 is a block diagram of a control device for the image adjusting device.

The image adjusting device has a first detector 53 for detecting the rotational position of the rubber blanket cylinder 101, a second detector 63 for detecting the rotational position of the cylinder gear 107, a memory means M (FIG. 5) for memorizing the respective standard and present rotational phase differences between the rubber blanket cylinder 101 and the cylinder gear 107, and an input means for inputting an adjustment amount of image position on the basis of the present rotational phase difference. In addition, the image adjusting device has a microcomputer 71 as shown in FIG. 5, to which are connected an operational panel 72 with a display 73 and ten keys 74, a standard point memorizing button 70 which is pushed for a standard point memorizing operation. The encoder 12 supported on the rotary shaft 116*a*, the first detector 53 comprising a megnetic proximity switch, the second detector 63 comprising a magnetic proximity switch, the motor 27 as a driving source and the solenoid 30 for operating the clutch mechanism are connected to the microcomputer 71. Referring back to FIG. 4, the first and second detectors 53 and 63 are supported on two brackets 54 and 64, respectively, which are fixed to the frame 113 of the printing machine.

Figure 8:
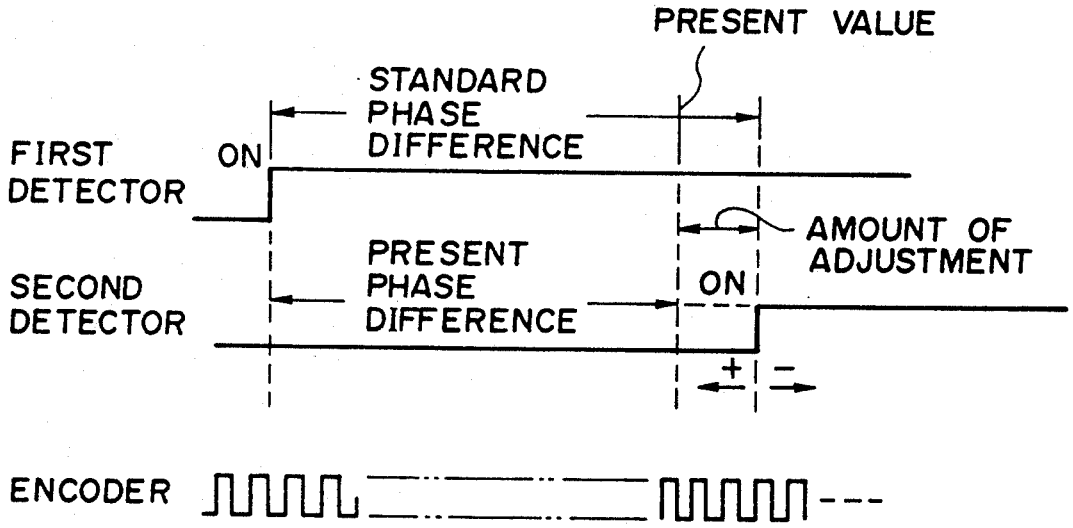
FIG. 8 is a sequential view for detecting the present value.

The rubber blanket cylinder 101 and the compression cylinder 103 have two projecting axes 51 and 61 which pass through the frame 113 while being supported by two bearings 50 and 60, respectively. The projecting axes 51 and 61 have, at their projected ends, two rotational detection bars 52 and 62, respectively. The first detector 53 is turned on when the detection bar 52 rotated in synchronism with the rubber blanket cylinder 101 faces the detector 53 while the second detector 63 is turned on when the detection bar 62 rotated in synchronism with the cylinder gear 107 for rotating the blanket cylinder 101 during a normal printing operation via the cylinder gear 108 of the compression cylinder 103 faces the second detector 63. The phases (angular positions) of detection bars 52 and 62 are deviated from each other by a predetermined value when a phase difference between the rubber blanket cylinder 101 and the cylinder gear 107 takes a standard amount, the center of the gear sector 119 then being engaged with the worm 129. The difference between the phases of the two bars 52 and 62 corresponds to a period of time from when the first detector 53 is turned on to when the second detector 63 is turned on as shown in FIG. 8. The rotational positions of the rubber blanket cylinder 101 and the cylinder gear 107 are deviated from their standard positions, and, accordingly, timings at which the first and second detectors 53 and 63 are turned on are deviated from each other. The rotary encoder 12 generates pulses as shown in FIG. 8 in accordance with the rotation of the rubber blanket cylinder 101. The microcomputer 71 has a counter for counting the number of pulses to obtain the difference between the phases of the standard positions of the rubber blanket cylinder 101 and the cylinder gear 107 and between the phases of the present positions thereof.

It is desirable that the detection bars 52 and 62 are so disposed that the order in which the first and second detectors 53 and 63 are turned on is not changed, however large the amount of image adjustment may be (even in case that the phases of the rubber blanket cylinder 101 and the cylinder gear 107 are deviated maximally from each other).

Each of the first and second detectors 53 and 63 is a magnetic proximity switch as mentioned above; however, it may be composed of a photosensor or the like. The first and second detectors 53 and 63 may be provided at any positions where they can detect the rotational positions of the rubber blanket cylinder 101 and the cylinder gear 107.

The microcomputer 71 has the memory M for memorizing the standard positions of the rubber blanket cylinder 101 and the cylinder gear 107 and the present positions thereof as e.g., the number of pulses. The input means comprises the ten keys 74 for inputting an amount of image adjustment in millimeter units into the microcomputer 71. The display 73 represents a standard point (standard phase difference) as $\pm 0$ and a present position as an amount of displacement from the standard point in millimeter units. The microcomputer 71 has a calculation function or means for converting the number of pulses into a value in millimeters to represent a present position. The standard point memorizing button 70 is disposed at a predetermined position of the frame 113 to be operated when the standard point (standard phase difference) is memorized in the memory M.

The operation of this device will now be explained.

An operator moves relatively the rubber blanket cylinder 101 and the cylinder gear 107 to their respective standard points by rotating the adjustment gear 116, and the rubber blanket cylinder 101 and the compression cylinder 103 are then rotated by a driving mechanism (not shown) to detect the standard phase difference between the standard points of the rubber blanket cylinder 101 and the cylinder gear 107.

Figure 6:
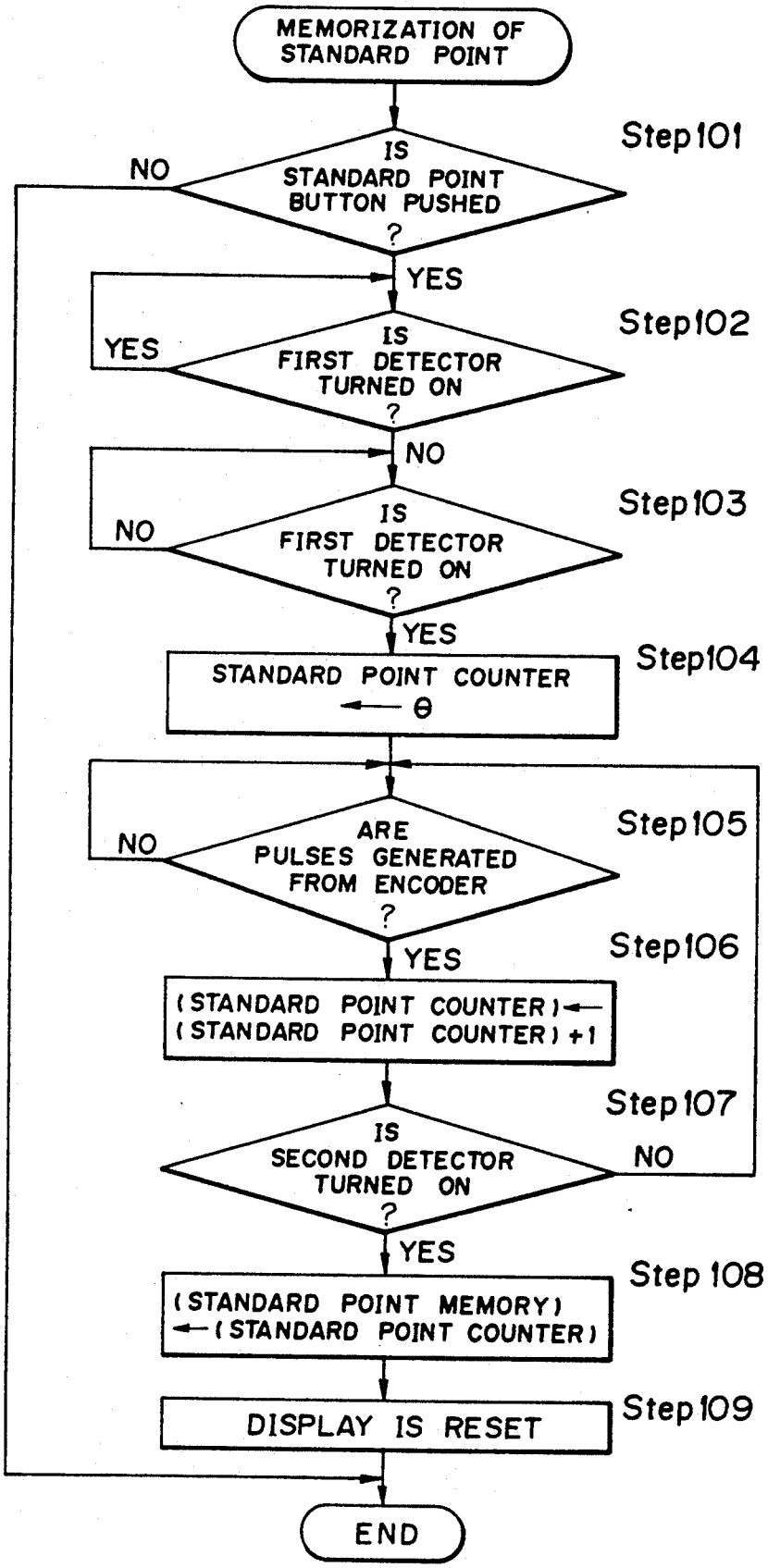
FIG. 6 is a flow chart showing an operation for memorization of a standard point.

A standard point memorizing operation is performed in a manner shown in FIG. 6.

First, the operator pushes the standard point memorizing button 70 while operating the printing machine. The microcomputer 71 discriminates whether or not the standard point memorizing button 70 is pushed (STEP 101). If YES in STEP 101, the microcomputer 71 waits for a timing when the first detector 53 is turned on from a state wherein it is turned off (STEP 102 and STEP 103), and a counter in RAM (memory M) for detecting the standard phase difference is initialized (STEP 104). Then, if the encoder 12 generates pulses (STEP 105), the counter is incremented one by one when the pulses are inputted therein (STEP 106). If the second detector 63 is turned on (STEP 107), the value of the counter is memorized in the RAM (STEP 108) and the display 73 is then reset (STEP 109) to display ±0 therein. That is, the counter calculates the number of pulses generated by the rotary encoder 12 from the turning-on of the first detector 53 to the turning-on of the second detector 63, and the counted number of pulses is memorized in the memory M as the standard phase difference (standard point).

A printing operation is then started. If the operator finds a displacement or shear of an image from a printed article, the printing machine is stopped to input an amount of image adjustment in millimeter units to eliminate the image displacement. The microcomputer 71 drives the drive motor 27 to drive a gear transmission mechanism disposed between the drive motor 27 and the sector gear 119 including the clutch mechanism to change the phase difference between the rubber blanket cylinder 101 and the cylinder gear 107. At this time, the image displacement is not necessarily completely eliminated because of a backlash in the second gear transmission mechanism between the adjustment gear 116 and the sector gear 119. The adjustment amount is displayed as a present phase difference on the display 73.

Figure 7:
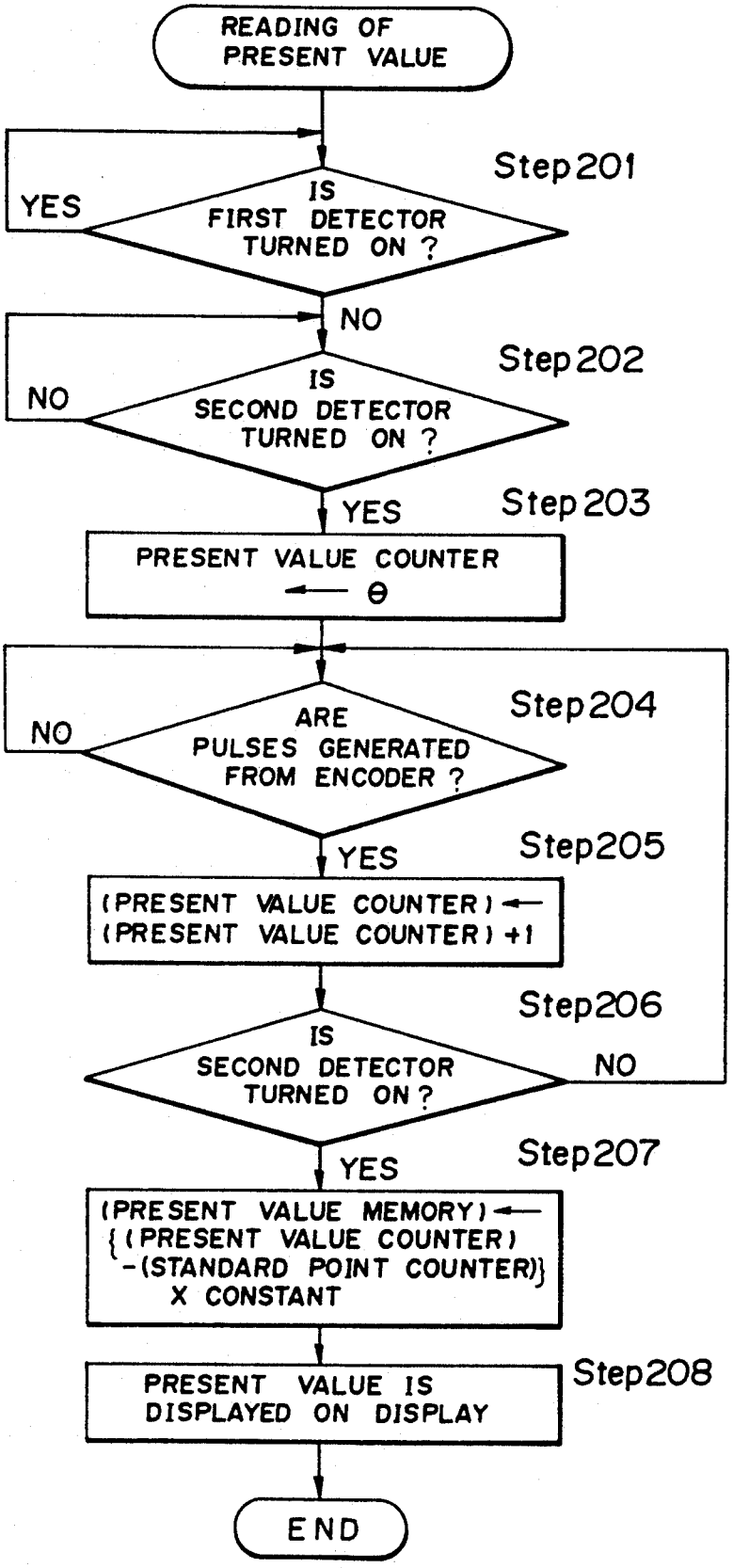
FIG. 7 is a flow chart showing an operation for reading of a present value.

The present phase difference is detected in a manner as shown in FIG. 7.

The microcomputer 71 waits for a timing at which the first detector 53 is turned on from a state wherein it is turned off (STEP 201 and STEP 202). If YES in STEP 202, a counter in the memory M for counting the present phase difference is initialized (STEP 203). The counter is incremented one by one in accordance with the input of pulses (STEP 205) after the encoder 12 generates pulses (STEP 204). The counter counts the number of pulses until the second detector 63 is turned on (STEP 206). The microcomputer 71 calculates a difference between the memorized standard phase difference as a number of pulses and the counted present phase difference as a number of pulses. Such an equation is as follows.

{(value of the present counter)−(value of the standard point counter)}×constant

The constant functions to convert the number of pulses into an actual displacement in millimeter units. The calculated value is memorized in the memory M (STEP 207), and is displayed as a present value on the display 73 (STEP 208).

If any image displacement is recognized thereafter, the operator stops the printing machine to input an amount of the image adjustment in the unit of millimeter through the ten keys 74 into the microcomputer 71. The amount of the image adjustment is a value on the basis of the present value. Then, the relative positional relationship between the rubber blanket cylinder 101 and the cylinder gear 107 is changed in accordance with the amount to be inputted through the input means.

In this manner, if an adjusting amount is determined and inputted on the basis of a present value, the influence of the backlash in the gear transmission mechanism between the adjustment gear 116 and the sector gear 119 can be effectively eliminated. Because the amount of adjustment in the first adjusting operation includes the influence of the backlash in the second gear transmission mechanism, the amount of relative rotary movement between the rubber blanket cylinder 101 and the cylinder gear 107 is substantially equal to the amount of adjustment which is inputted into the microcomputer 71 in the successive adjusting operations after the first adjusting operation. Thus, the adjusting operation is repeated successively on the basis of the present value (value of present phase difference between the cylinder 101 and the cylinder gear 107 when the operator finds a shear of images in printing.

In the above embodiment, the image adjusting operation is carried out by changing the phase difference between the rubber blanket cylinder 101 and the cylinder gear 107; however, the image adjusting operation may be carried out by changing the phase difference between a plate cylinder and a cylinder gear which corresponds to the cylinder gear 107 and is provided around the plate cylinder.

Further, since the present value is always displayed on the display 73, the blanket cylinder 101 and the cylinder gear 107 can be easily returned to the their standard positions.

What is claimed is:

1. An image adjusting device for an offset printing machine, comprising:

a drive source for driving a gear transmission mechanism by which a phase difference between a cylinder and a cylinder gear for rotating the cylinder is changed;

an adjustment gear always engaged with the cylinder gear which is mounted on said cylinder for adjusting a position of an image to be printed;

a rotational clutch mechanism for selectively transmitting a rotation of the drive source to said adjustment gear for adjusting the phase difference between the cylinder and the cylinder gear; and a rotational amount control means for controlling a rotational amount of said adjustment gear, said rotational amount control means being mounted at a first end of a rotary shaft on which said adjustment gear is mounted at a second end.

2. An image adjusting device according to claim 1, wherein said clutch mechanism includes a pair of first and second spur gears which are arranged coaxially with each other adjacent to each other and a third spur gear which is always engaged with said first spur gear, said third spur gear being movable in an axial direction of said pair of spur gears for transmitting a rotation of said first spur gear to said second spur gear.

3. An image adjusting device according to claim 2, further comprising an axially moving means for drivingly moving said third gear in its axial direction, said axially moving means including a solenoid for selectively moving said third spur gear in a first direction, a spring biasing means for moving said third spur gear in a second direction, and a link mechanism interposed between said solenoid and said spring biasing means.

4. An image adjusting device according to claim 1, wherein said rotational amount control means includes a rotary encoder for detecting an exact rotational amount of said adjustment gear.

5. An image adjusting device according to claim 4, wherein said rotary encoder starts to detect said exact rotational amount after said third spur gear is engaged with said second spur gear.

6. The image adjusting device according to claim 5, wherein said drive source comprises a motor.

7. An image adjusting device for an offset printing machine, comprising:

a drive source for driving a gear transmission mechanism by which a phase difference between a cylinder and a cylinder gear for rotating the cylinder is changed;

a first detecting means for detecting a rotational position of the cylinder;

a second detecting means for detecting a rotational position of the cylinder gear;

a calculating means for calculating a standard phase difference between the cylinder and the cylinder gear when the cylinder and the cylinder gear are located at their respective standard positions and a present phase difference therebetween;

a memory means for memorizing the standard and present phase differences therebetween;

an input means for inputting an amount of adjustment on the basis of the present phase difference therebetween; and a rotational control means for controlling the gear transmission mechanism to change the present phase difference therebetween in response to the amount of adjustment inputted through the input means.

8. An image adjusting device according to claim 7, further comprising a display for displaying the present phase difference on the basis of the standard phase difference.

9. An image adjusting device according to claim 7, wherein said calculating means includes a standard point memorizing button and said calculating means starts to calculate the standard phase difference after said standard point memorizing button is pushed.

10. An image adjusting device according to claim 7, wherein said first detecting means comprises a proximity switch provided on a frame and a rotary detection bar fixed to an axis of the cylinder, and said second detecting means comprises a proximity switch provided on the frame and a rotary detection bar fixed to an axis of another cylinder rotated in synchronism with the cylinder, the rotational position of said rotary detection bar of said second detecting means being representative of the rotational position of the cylinder gear.

11. An image adjusting device according to claim 7, wherein said input means includes ten keys.

12. An image adjusting device according to claim 7, wherein said calculating means for calculating the standard and present phase differences counts number of pulses generated by an encoder which is provided in the gear transmission mechanism from when the first detecting means is turned on to when the second detecting means is turned on.

13. An image adjusting device according to claim 7, wherein said gear transmission mechanism includes an adjustment gear always engaged with the cylinder gear which is mounted on the cylinder for adjusting a position of an image to be printed, a rotational clutch mechanism for selectively transmitting a rotation of the drive source to said adjustment gear for adjusting the phase difference between the cylinder and the cylinder gear and a rotational amount control means for controlling a rotational amount of said adjustment gear, said rotational amount control means being mounted at a first end of a rotary shaft on which said adjustment gear is mounted at a second end.

14. An image adjusting device according to claim 13, wherein said clutch mechanism includes a pair of first and second spur gears which are arranged coaxially with each other adjacent to each other and a third spur gear which is always engaged with said first spur gear, said third spur gear being movable in an axial direction of said pair of spur gears for transmitting a rotation of said first spur gear to said second spur gear.

* * * * *